United States Patent [19]

Troebel

[11] 4,286,130

[45] Aug. 25, 1981

[54] LOW VOLTAGE CIRCUIT BREAKER WITH SUBDIVIDED INSULATING HOUSING

[75] Inventor: Werner Troebel, Berlin, Fed. Rep. of Germany

[73] Assignee: Siemens Aktiengesellschaft, Berlin & Munich, Fed. Rep. of Germany

[21] Appl. No.: 4,207

[22] Filed: Jan. 17, 1979

[30] Foreign Application Priority Data

Jan. 19, 1978 [DE] Fed. Rep. of Germany ..... 2802554

[51] Int. Cl.[3] ..... H01H 9/02

[52] U.S. Cl. ..... 200/303; 200/306; 220/4 B

[58] Field of Search ..... 200/293, 303, 306, 144 R; 220/4 B, 4 E

[56] References Cited

U.S. PATENT DOCUMENTS

| | | | |
|---|---|---|---|
| 2,047,739 | 7/1936 | Lingal | 200/144 R X |
| 2,492,726 | 12/1949 | Ayers et al. | 200/144 R |
| 2,684,417 | 7/1954 | Cole et al. | 200/144 R |
| 2,863,969 | 12/1958 | Edmunds | 200/306 X |
| 3,043,939 | 7/1962 | Gryctko et al. | 200/144 R |
| 3,415,407 | 12/1968 | Alden et al. | 220/4 B |
| 3,632,939 | 1/1972 | Yorgin et al. | 200/293 |

*Primary Examiner*—Stephen Marcus
*Attorney, Agent, or Firm*—Kenyon & Kenyon

[57] ABSTRACT

A low voltage circuit breaker has a housing of insulating material divided into an upper part and a lower part along a parting gap. The interior of the housing is subdivided by partitions to accommodate the adjacent pole channels of a multiple pole circuit breaker. The partitions of the upper part and the lower part overlap along their entire length and the outside walls of both housing parts overlap essentially over their entire length having only short interruptions. The overlap of the outer walls and the partitions lengthen the electrical leakage paths within the housing and between adjacent insulating housing and prevent the passage of switching gases into adjacent breaker spaces and between adjacent breakers.

6 Claims, 7 Drawing Figures

LOW VOLTAGE CIRCUIT BREAKER WITH SUBDIVIDED INSULATING HOUSING

BACKGROUND OF THE INVENTION (a) Field of the Invention

This invention relates to a circuit breaker housing which is made of insulating material which is divided into upper and lower parts along a parting gap, and which has stepwise overlapping partitions between pole channels.

(b) Description of the Prior Art

A circuit breaker of this type, but in which the stepwise overlap of the partitions is found only sectionally, is described in U.S. Pat. No. 3,632,939 (corresponding to British Pat. No. 1,300,203). If such circuit breakers are subjected to heavy electrical stresses, the switching gases produced in the arcing chambers can get into the adjacent pole channel and around the overlapping sections provided in the vicinity of the arching chambers at the partitions. Internal breakdowns can thus come about in spite of the protective measures provided.

A further difficulty arises if identical breakers are to be mounted directly side by side in a switching installation or on a switchboard. Then, the switching gases escaping at the parting gap between the upper part and the lower part of one breaker can get into the adjacent pole channel of a neighboring circuit breaker. Again, breakdowns can occur. In both exposed regions, at the partitions and at the outer walls of adjacent breakers, electrical leakage paths can form in the course of time which are detrimental to reliable operation of the breaker.

SUMMARY OF THE INVENTION

It is therefore an object of the invention to provide a circuit breaker of the type described which has substantially increased safety against the passage of switching gases into adjacent pole channels as well into neighboring breakers and against the formation of electrical leakage paths formed at the points mentioned.

According to the present invention, the above problem is solved by providing an overlap along the entire length of the partitions of the upper part and the lower part as well as essentially along the entire length of the outer walls. The complete overlap of the partitions forms barriers which force the switching gases to escape from the housing of the circuit breaker only at the points provided and prevents communication between sections. An essentially complete overlap, in which only short sections such as are needed for bringing electrical auxiliary lines out laterally are excepted from the step-wise overlap, has been found to be sufficient in the region of the outer walls. Such interruptions of the overlap, when provided, are located at different points in adjacent breakers. A continuous step-wise overlap exists between adjacent outer walls of two circuit breakers, just as exists between the partitions of the same breaker. It is a further feature of the invention that this object is met by stepping or staggering the relationship between interruptions in the two outer walls of a breaker; then, if several, like, breakers are arranged side by side, non-alignment of the interruptions of the steps is automatically provided for.

Ordinarily, the upper and lower parts of breakers of this type are held together by connecting elements which extend through the partitions in the vicinity of the ends of the housing. Since metal screws are generally used as connecting elements, the leakage path between adjacent pole channels is shortened by the width of screws. The screws can also cause stray voltages. To eliminate these problems in the past, cylindrical extensions surrounding the screw holes have been provided at the partitions (U.S. Pat. No. 3,632,939). According to a further teaching of the present invention, the leakage path in the vicinity of the screw holes is lengthened by making the partitions of one part of the housing forked, in the vicinity of the screw holes, so that one arm of the fork forms part of the wall of a screw hole.

According to another aspect of the invention, the screw holes can be completely included in the raised part of the partitions of one housing part, i.e. the upper part or the lower part, and the region containing the screw holes can be incorporated between the raised part of the partitions of the other housing part and an additional raised part. Which particular structure is most advantageous depends on the thickness of the partitions available in each case.

British Pat. No. 1,244,890 shows a structure having recesses in the partitions for supporting the switching shaft which serve, at the same time, as support surfaces. In such structures, the other half of the bearing is then formed by means of an insert which is placed in a recess in the partition and which closes it. In accordance with another teaching of the present invention, this arrangement is improved upon by providing inserts which extend in step fashion over the components to be supported in the partitions. Thus, a long leakage path and increased safety against the passage of switching gases are provided in the vicinity of the supports of components connecting adjacent pole channels to each other. Alternatively, the step principle may be applied by providing a disc-shaped rib surrounding the component to be supported; this rib engages a corresponding groove in the partition and in the insert. Again, the resulting structure leaves no gap connecting the adjacent pole channels in a straight line.

According to a further aspect of the invention, the step of the partitions and of the outer walls may be formed in such a way that the upper and the lower part of the insulating material housing can be displaced lengthwise relative to each other. It is more or less unavoidable, in practice, to make the steps with a lateral offset or to provide engaging lateral recesses and projections at some points and interlocking shapes result which can limit or prevent longitudinal displacement of the housing parts. Therefore, according to another teaching of the invention, the partitions of the upper and the lower part of the housing are provided with a single lateral projection or setback for engaging each other accurately near one of the ends are loosely fitted and while all other projections and setbacks engage with play along the length of engaging overlap. Thus, a dimensionally accurate fit of the upper part on the lower part and provision for transfer of force in the lengthwise direction between these parts are achieved without the need for making all the other projections and setbacks with the same degree of accuracy. The connecting screws then only have the function of supplying contact pressure between the upper part and the lower part.

It has also been found advantageous, where the screw holes are completely included in the raised parts of the partitions of one of the housing parts and corresponding recesses are provided in the other housing part, to place the above mentioned projections and set backs contiguous to the screw holes. It is then easier to maintain the tolerances required as to the relative position of the screw holes. Also, the projections and setbacks can be formed on at the contour of the area of the partitions which surrounds the screw holes.

DETAILED DESCRIPTION OF THE INVENTION

Figure 1:
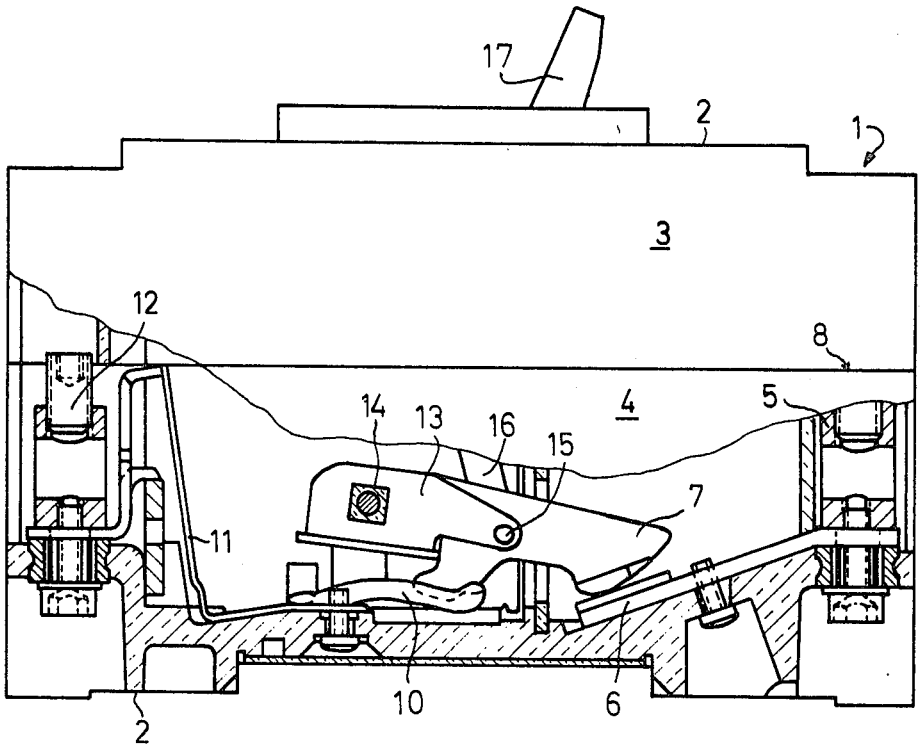
FIG. 1 is a side view in partial cross-section of a low-voltage circuit breaker fabricated in accordance with the teachings of the invention.

A circuit breaker 1 fabricated in accordance with the teachings of the invention is shown in simplified form in FIG. 1; it has a housing 2 of an insulating material such as molded polyester plastic. The housing 2 is divided into an upper part 3 and a lower part 4 along a parting gap 8. The path for current flow in the breaker extends from a terminal 5 via a stationary contact 6 to a movable contact 7; thence it flows via a flexible conductor 10 and a heating conductor 11 to terminal 12 at the other end of the housing 2. The movable contact 7 can be moved by means of a contact carrier 13 on a switching shaft 14. The joint pin 15 which connects the movable contact 7 and the contact carrier 13 is engaged by a drive lever 16; lever 16 can be moved manually by an operating handle 17 and a mechanism, known in the prior art but not shown, for switching on and off. The movable contact 7 can also be transferred from the "on" position shown in FIG. 1 into the "off" position automatically and independently of the operating handle 17 by means of a current or voltage dependent tripping device of a kind also well known in the art, but not shown.

Figure 2:
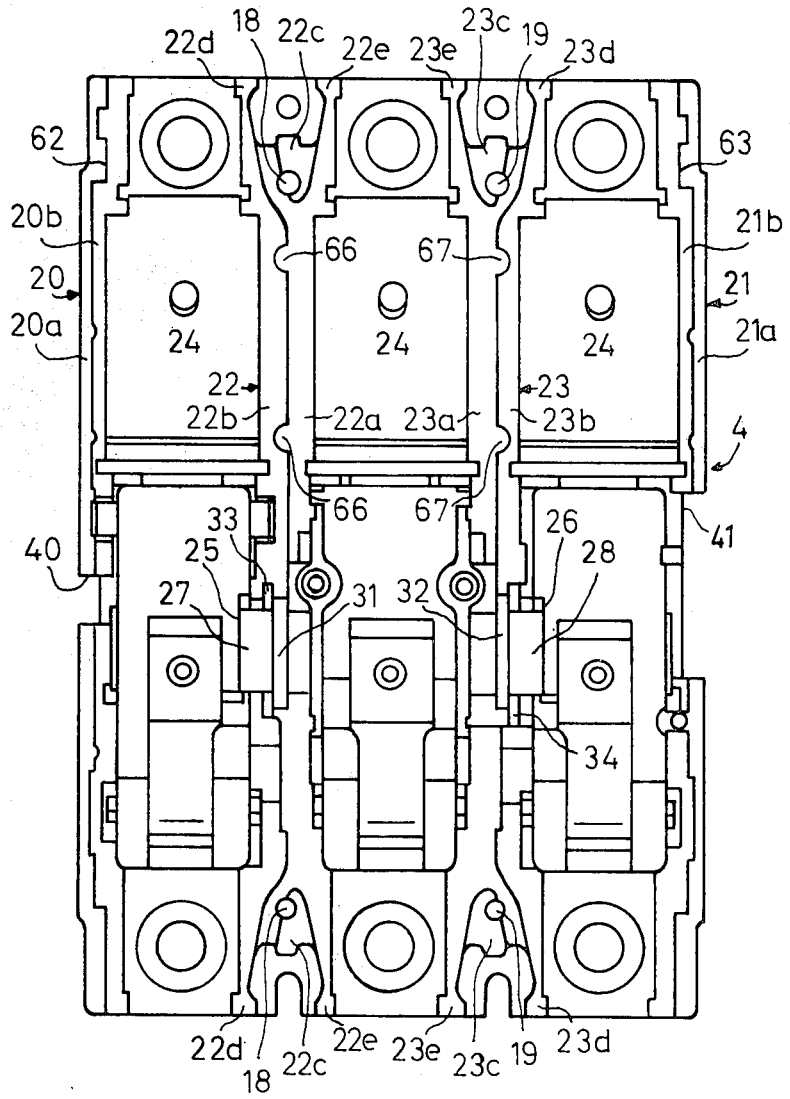
FIG. 2 is a view from above of the lower part of the circuit breaker of FIG. 1.

A top view onto the lower part 4 is shown in FIG. 2. The breaker 1 is a three pole circuit breaker and its lower part 4 has a left outer wall 20 and a right outer wall 21. The space between them is divided by two parallel partitions 22 and 23 which form three separate, but adjacent, chambers 24 for the pole channels of the breaker. Screw holes 18 and 19 are provided in the respective partitions, being located near the upper and the lower ends of the housing. They serve to connect the upper housing part 3 to the lower housing part 4.

Figure 5:
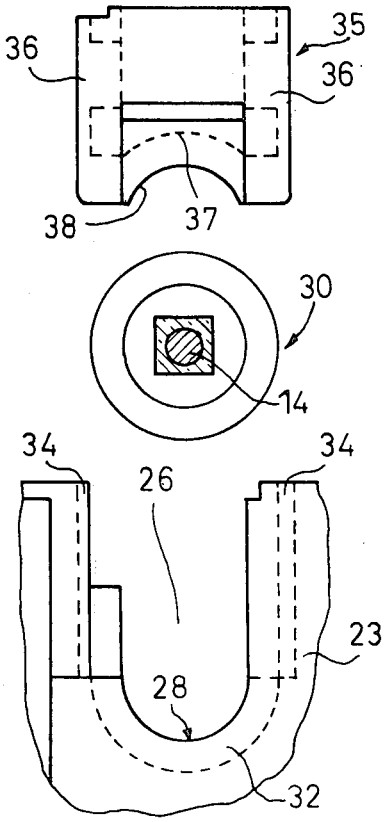
FIG. 5 shows details of a portion of a partition receiving a switching shaft, an isolation disc and an insert useful in the circuit braker of the invention.

Parallel partitions 22 and 23 have a step-like profile. That is, they have lower portions **22*a* and 23*a* and elevated, or raised, portions 22*b* and 23*b*, the surfaces of each lower portion being at right angles to the wall of the adjacent elevated portion. These "steps" run the length of the partitions. The screw holes 18 and 19 are located half in the lower parts or steps 22*a* and 23*a* and half in the island like raised parts 22*c* and 23*c*, respectively, which extend up to the height of the raised parts 22*b* and 23*b*. At the upper and lower end faces of the housing part 4, the partitions 22 and 23 each end in two ribs 22*d*, 22*e* and 23*d*, 23*e*, respectively. These ribs serve to lengthen the leakage path between the adjacent terminals 5 and between the adjacent terminals 12, respectively. Recesses 25 and 26, in partitions 22 and 23, respectively, provide support for switching shaft 14. The bottoms of these recesses form lower bearing shells 27 and 28, respectively. The switching shaft 14 is fitted through a pair of ribbed disc-like inserts 30 (see FIG. 5), which are then inserted into slots 31, 32 of each bearing shell 27, 28; steps are thus provided in the support of the switching shaft. In addition, slots 33 and 34 are provided in the partitions 22 and 23 at the sides of the recesses, into which gate-like inserts 35 provided with mating ribs (FIG. 5) can be placed. The insert 35 has a slot 37 matching the slots 31 and 32 and a bearing surface 38 for the switching shaft 14**.

The outer walls 20 and 21 are likewise provided with right angle steps and, therefore, have lower portions **20*a* and 21*a* as well as raised portions 20*b* and 21*b*. The raised portions of outer walls 20 and 21 are interrupted at points where recesses in the form of slots 40 and 41 are provided. These slots serve as wire ducts for bringing out auxiliary lines from the housing 2** in such a way that the wires do not increase the width of the housing. The circuit breakers can therefore be mounted directly side by side when if the auxiliary lines are connected.

Figure 3:
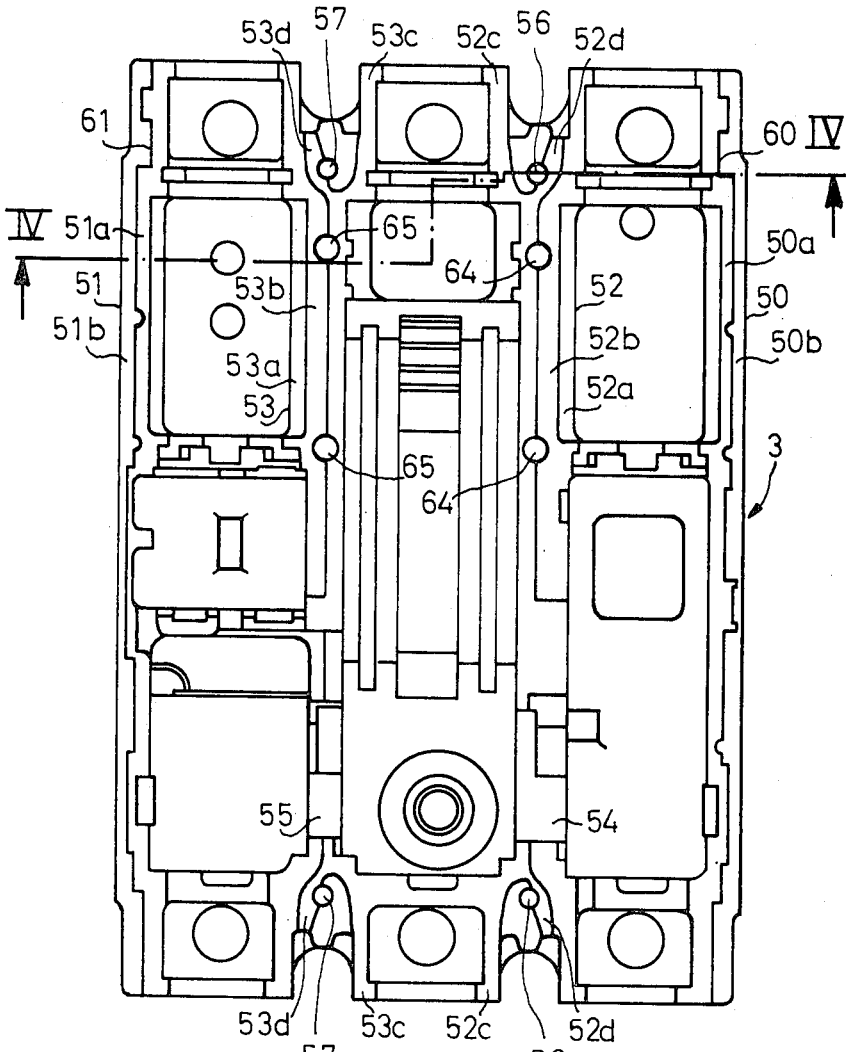
FIG. 3 is a view from below of the interior of an upper part for use with the lower part shown in FIG. 2.

The upper part 3 (FIGS. 3 and 4) has outer walls 50 and 51 and longitudinal parallel partitions 52 and 53. Continuous right angled steps are also provided along lengths of these walls, so that a step overlap of the mating walls and partitions is obtained everywhere when the upper part 3 is placed on the lower part 4. To this end, the lower portions or steps **52*a* and 53*a* are located on the outside of the partitions and the raised portions 52*b* and 53*b* on the inside of the partitions 52 and 53. At the point where the recesses 25 and 26 are located in the partitions 22 and 23 of the lower part 4, the partitions 52 and 53 of the upper part 3 are continous. They cooperate at these points with the inserts 35. The partitions 52 and 53 of the upper part 3, however, have recesses 54 and 55 at another point for the passage of a release shaft. By making the release shaft recesses 54 and 55** in the form of steps, seals are proved here, too, against the passage of switching gases and for increasing the length of the leakage path.

The upper and lower ends of the partitions 52 and 53 contain screw holes 56 and 57 which are lined up with the screw holes 18 and 19 of the lower part. In the vicinity of these screw holes, the raised part **52*b* of the partition 52 and the raised part 53*b* of the partition 53 are forked. One fork arm 52*c* or 53*c*, respectively, extends to the end face of the upper part 3, while the other fork arm 52*d* or 53*d*, respectively, is shorter. A space for accepting the island-like raised parts 22*c* and 23*c* between the two fork arms of the partitions 22 and 23 of the lower part 4 is thus provided. As in the lower part 4, the screw holes 56 and 57 of the upper part 3 come out half at the plane of the lower parts 52*a* and 53*a* of the partitions 52 and 53 and half at the raised parts, i.e., the shorter fork arms 52*d* and 53*d***. These fork arms therefore form part of the wall of the screw holes.

Figure 4:
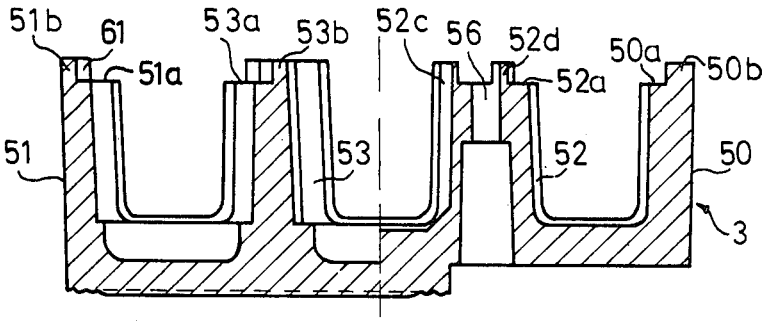
FIG. 4 is a view in cross section along lines IV—IV through the upper part of the circuit breaker shown in FIG. 3.

The outer walls 50 and 51 of the upper part 3 are made as steps along their entire length and accordingly have inner, lower parts **50*a* and 51*a*, as well as raised outer portions 50*b* and 51*b*. FIG. 4 shows partitions 52 and 53, outer walls 50 and 51, and hole 56** in cross-section and illustrates the step construction employed in accordance with the teachings of the invention.

Lateral projections 60 and 61 are provided near the upper ends of side walls 50*b* and 51*b* of the upper part 3, which cooperate with corresponding lateral setbacks 62 and 63 of the raised portions 20*b* and 21*b* of the lower part 4. These projections and setbacks are so arranged that the position of the upper part 3 relative to the lower part 4 in the lengthwise direction of the housing 2 is determined, and so that force can be transmitted at these points. The remaining projections and setbacks, for instance, the projections 64 and 65 in partitions 52 and 53, provided for the ejector pins, and the setbacks 66 and 67 of the partitions 22 and 23 of the lower part 4, are designed so that they engage loosely, i.e., with play between them, and thereby do not interfere with the dimensionally accurate location of the housing parts provided by the projections 60 and 61 and the setbacks 62 and 63.

The slots 40 and 41 of the lower part 4 are covered up by the raised parts 50*b* and 51*b* of the upper part 3 when the housing parts are put together (FIG. 1). Escaping gases are thus caused to be deflected lengthwise in the direction of the slots 40 and 41; i.e., the gas flow runs essentially parallel to the outer walls of the lower part 4. The escape of gas is limited still further when the slots 40 and 41 are occupied by auxiliary lines, as intended, the associated auxiliary devices being arranged inside the housing 2. The interruption of the step overlap in the region of the raised parts of the outside walls of the lower part 4 therefore has no adverse effect if two or three breakers are mounted close together.

Figure 6:
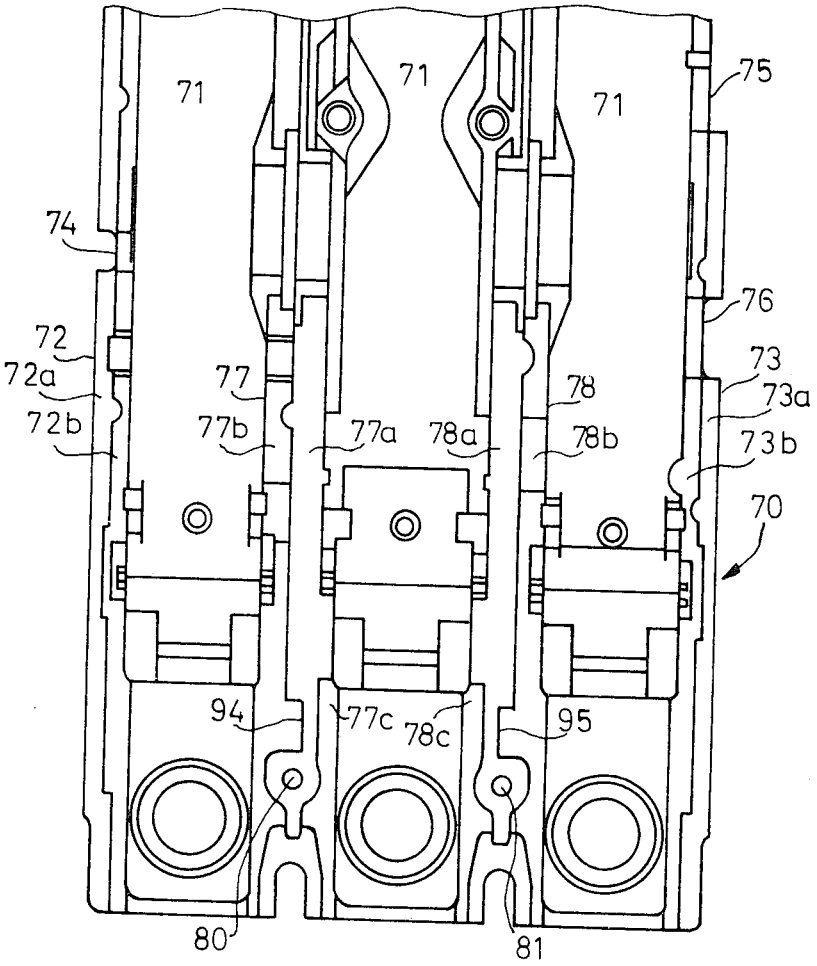
FIG. 6 is a top view of a portion of the lower part of another breaker in accordance with the invention.
Figure 7:
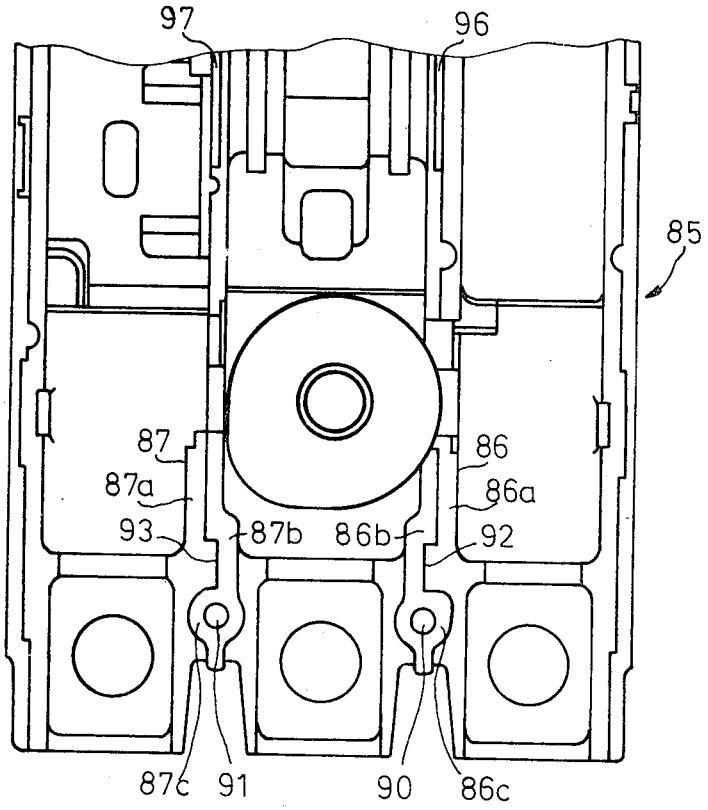
FIG. 7 is a view of a portion of the upper part of the breaker of FIG. 6.

Another embodiment of a circuit breaker housing, built in accordance with the teachings of the invention, is shown in FIGS. 6 and 7 where approximately one-half of the lower part 70 and of the upper part 85 of another housing is shown. Like the housing of the first embodiment, the lower housing part 70 has three parallel chambers 71 for receiving the pole channels of the breaker. The outer walls 72 and 73 are provided with outer, lower portions or steps 72*a* and 73*a* as well as with inner, raised step portions 72*b* and 73*b*. The raised parts are interrupted only in the vicinity of recess or slot 74 of the outer wall 72 and of recesses or slots 75 and 76 of the outer wall 73 up to the level of the steps 72*a* and 73*a*. Slot 74 in outer wall 72 is staggered relative to slots 75 and 76 of outer wall 73 in such a way that a continuous step overlap of the outer walls is provided between adjacent breaker walls when circuit breakers are placed next to each other.

The partitions 77 and 78 have low portions or steps 77*a* and 78*a* facing each other into which screw holes 80 and 81 are let. In the vicinity of the screw holes, the raised portions 77*b* and 78*b* in each partition face additional raised portions 77*c* and 78*c*, respectively, which, like the raised portions 77*b* and 78*b* extend to the end face of the lower part 70.

The mating upper part 85 (FIG. 7) has partitions 86 and 87, the raised portions 86*b* and 87*b* of which have enlarged parts or bosses 86*c* and 87*c*, respectively, surrounding screw holes 90 and 91; screw holes 90 and 91 are lined up with screw holes 80 and 81 of the lower part 70. These raised portions and bosses are accepted between the raised parts 77*b* and 77*c* and 78*b* and 78*c*, respectively, when the upper part 85 is placed on the lower part 70. Lateral rectangular setbacks or recesses 92 and 93 are provided close to these enlarged regions 86*c* and 87*c* which cooperate with corresponding lateral projections 94 and 95 of the lower part 70, in the manner already described, to fix the position of the upper part 85 relative to the lower part 70 in the lengthwise direction, and to make possible transmission of force between the parts in the longitudinal direction.

Slot-like recesses 96 and 97 are provided in raised parts 86*b* and 87*b* of the upper part 85 in the vicinity of the inserts (not shown) which serve to support the switching shaft; recesses 96 and 97 extend to a point below the lower portions 86*a* and 87*a* of partitions 86 and 87 and accept the corresponding, mating ribs of the inserts in order to obtain an even further labyrinthine nesting of the parts than is attained by cooperating mating of the steps in the meeting walls.

As can be seen from the preceding description of two embodiments of the invention, a nesting effect is achieved by the step overlap at all partitions and outer walls of the housings, except for slight local interruptions at the outer walls of the lower parts; this nesting prevents switching gases from passing into adjacent pole channels of the same or of an adjoining breaker, even via detours. At the same time, the leakage paths are considerably lengthened everywhere. Where components connecting the adjacent pole channels are provided, e.g. a switching shaft or a release shaft, the inserts, which also cooperate in a nested configuration with these components, provide sealed and lengthened leakage paths. The step design of the partitions and the outer walls is at the same time utilized for securing the position and for providing for transmission of mechanical forces between the housing parts in their lengthwise direction by means of the worked-in, lateral projections and setbacks.

What is claimed is:

1. In a low voltage circuit breaker having an insulating material housing divided into an upper part and a lower part along a parting gap and having partitions between adjacent breaker pole channels meeting at the parting gap, the partitions overlapping each other stepwise, each breaker pole channel comprising a pole path having a terminal, a stationary switch contact, a movable switch contact, a flexible connector, means for opening the contacts, and a second terminal, there being a drive shaft for actuating the movable switch contacts coupled to a mechanism located in one of the pole channels, the improvement comprising:

the entire length of the partitions of the upper part and of the lower part having step-wise overlap with each other and substantially the entire length of the outer walls of both housing parts having stepwise overlap with each other, interruptions of the overlap in the region of the two outer walls being arranged in staggered relation to each other.

2. In a low voltage circuit breaker having an insulating material housing divided into an upper part and a lower part along a parting gap and having partitions between adjacent breaker pole channels meeting at the parting gap, the partitions overlapping each other stepwise, each breaker pole channel comprising a pole path having a terminal, a stationary switch contact, a movable switch contact, a flexible connector, means for opening the contacts, and a second terminal, there being a drive shaft for actuating the movable switch contacts coupled to a mechanism located in one of the pole channels, the improvement comprising:

the entire length of the partitions of the upper part and of the lower part having step-wise overlap with each other and substantially the entire length of the outer walls of both housing parts having step-wise overlap with each other, the partitions of one housing part having raised portions which are forked in the vicinity of the screw holes and an arm of the fork forming part of the wall of the associated screw hole.

3. In a low voltage circuit breaker having an insulating material housing divided into an upper part and a lower part along a parting gap and having partitions between adjacent breaker pole channels meeting at the parting gap, the partitions overlapping each other stepwise, each breaker pole channel comprising a pole path having a terminal, a stationary switch contact, a movable switch contact, a flexible connector, means for opening the contacts, and a second terminal, there being a drive shaft for actuating the movable switch contacts coupled to a mechanism located in one of the pole channels, the improvement comprising:

the entire length of the partitions of the upper part and of the lower part having step-wise overlap with each other and substantially the entire length of the outer walls of both housing parts having stepwise overlap with each other, and screw holes completely included in raised portions of the partitions of one housing part, each portion containing a screw hole being accepted between raised portions of partitions of the other housing part and an additional raised part associated with each partition.

4. In a low voltage circuit breaker having an insulating material housing divided into an upper part and a lower part along a parting gap and having partitions between adjacent breaker pole channels meeting at the parting gap, the partitions overlapping each other stepwise, each breaker pole channel comprising a pole path having a terminal, a stationary switch contact, a movable switch contact, a flexible connector, means for opening the contacts, and a second terminal, there being a drive shaft for actuating the movable switch contacts coupled to a mechanism located in one of the pole channels, the improvement comprising:

the entire length of the partitions of the upper part and of the lower part having step-wise overlap with each other and substantially the entire length of the outer walls of both housing parts having stepwise overlap with each other, the partitions separating adjacent pole channels having step-containing recesses connecting the pole channels for passage of components between the pole channels and inserts which extend over the components in stepwise fashion inserted into the recesses.

5. In a low voltage circuit breaker having an insulating material housing divided into an upper part and a lower part along a parting gap and having partitions between adjacent breaker pole channels meeting at the parting gap, the partitions overlapping each other stepwise, each breaker pole channel comprising a pole path having a terminal, a stationary switch contact, a movable switch contact, a flexible connector, means for opening the contacts, and a second terminal, there being a drive shaft for actuating the movable switch contacts coupled to a mechanism located in one of the pole channels, the improvement comprising:

the entire length of the partitions of the upper part and of the lower part having step-wise overlap with each other and substantially the entire length of the outer walls of both housing parts having stepwise overlap with each other, and means comprising no more than two mating projections and setbacks near one end of the housing for establishing accurate longitudinal engagement between the partitions and outer walls of both housing parts, all other projections and setbacks along the outer walls and partitions of both housing parts meeting loosely.

6. A circuit breaker in accordance with claim 5 in which partitions have raised portions which accommodate screw holes and the projections and setbacks are included in the raised portions.

* * * * *